US005153650A

United States Patent [19]

Maeshima

[11] Patent Number: 5,153,650

[45] Date of Patent: Oct. 6, 1992

[54] TONER CONTAINER AND PROCESS UNIT INCLUDING THE SAME

[75] Inventor: Masanobu Maeshima, Habikino, Japan

[73] Assignee: Mita Industrial Co., Ltd., Osaka, Japan

[21] Appl. No.: 684,208

[22] Filed: Apr. 12, 1991

[30] Foreign Application Priority Data

Apr. 27, 1990 [JP] Japan ..... 2-112228

[51] Int. Cl.[5] ..... G03G 15/06

[52] U.S. Cl. ..... 355/260; 222/324; 222/541; 222/DIG. 1

[58] Field of Search ..... 355/260, 245, 246; 118/653; 222/DIG. 1, 541, 325

[56] References Cited

U.S. PATENT DOCUMENTS

| | | | |
|---|---|---|---|
| 3,385,500 | 5/1968 | Lavander | 222/DIG. 1 X |
| 4,349,132 | 9/1982 | Macaluso et al. | 222/DIG. 1 X |
| 4,752,807 | 6/1988 | Mort | 222/DIG. 1 X |
| 4,895,104 | 1/1990 | Yoshino et al. | 355/260 X |

FOREIGN PATENT DOCUMENTS

| | | |
|---|---|---|
| 60-76360 | 5/1985 | Japan . |
| 63-29143 | 2/1988 | Japan . |
| 63-120264 | 8/1988 | Japan . |

*Primary Examiner*—A. T. Grimley
*Assistant Examiner*—Shuk Y. Lee
*Attorney, Agent, or Firm*—Beveridge, DeGrandi & Weilacher

[57] ABSTRACT

A process unit includes a unit frame having a pair of walls arranged in a width direction to maintain a distance and a developing device mounted between the pair of side walls of the unit frame. The developing device has a toner container that includes a container body having an opening formed in the bottom surface thereof and a sealing member that is peelably stuck to the bottom surface of the container body to close the opening. The sealing member has one end to which is coupled a grip member that can be pulled to remove the sealing member from the bottom surface of the container body to open the container opening. An anchor means is disposed on a wall on one side of the container body, so that the grip member is detachably anchored thereto without outwardly protruding in the width direction. The grip member extends along the wall of the container body. An opening and a mounting device are disposed at a wall on one side of the unit frame and are juxtaposed with respect to each other. The grip member is detachably mounted on the mounting device so as to partly protrude outwardly through the opening in the unit frame wall.

12 Claims, 6 Drawing Sheets

TONER CONTAINER AND PROCESS UNIT INCLUDING THE SAME

FIELD OF THE INVENTION

The present invention relates to a toner container, and more specifically to a toner container of a form in which an opening formed in the bottom surface of the container body is closed by a peelable sealing member as well as to a process unit in an image-forming apparatus equipped with a developing device that includes the toner container.

DESCRIPTION OF THE PRIOR ART

An image-forming apparatus having a so-called process unit that is detachably mounted in a housing has been disclosed in U.S. patent application Ser. No. 07/430,339 (entitled IMAGE-FORMING MACHINE, filed Nov. 2, 1989) of Nobuhiko KOZUKA et al. and in corresponding European Patent Application No. 89120900.9 (entitled IMAGE-FORMING MACHINE, filed Nov. 10, 1989). A process unit which is renewedly exchanged after repetitive use for a predetermined number of times is equipped with a unit frame which is provided with a rotary drum having a electrostatographic material disposed on the peripheral surface thereof, and a corona discharger for charging electricity, a developing device and a cleaning device disposed at the periphery of the drum. The developing device is constituted by a main portion having a magnetic brush mechanism disposed therein and a toner container provided in the main portion. The toner container includes a container body having an opening formed in the bottom surface thereof and a sealing member which is peelably stuck to the bottom surface of the container body to close the opening, and the toner is contained in the container body. The sealing member has a stuck portion that extends from one side to the other side of the container body and that is peelably stuck to the bottom surface of the container body, and a folded portion that extends from said other side to said one side of the container body along the outer surface of the stuck portion. At the time of using the process unit by mounting it at a required position in the housing, the free end of the folded portion of the sealing member is pulled to peel off the stuck portion of the sealing member from the container body thereby to open the opening. Then, the toner contained in the container body is permitted to be fed to the main portion of the developing device through the opening.

According to Japanese Utility Model Laid-Open Publication No. 76360/1985 (Sho60-76360), Japanese Utility Model Laid-Open Publication No. 120264/1988 (Sho63-120264) and Japanese Utility Model Laid-Open Publication No. 29143/1988 (Sho63-29143), a grip member is coupled to the free end of a sealing member in order to facilitate the operation for removing the sealing member of the toner container in the developing device, i.e., to facilitate the operation for removing the sealing member from the container body by pulling the free end of the sealing member. The grip member is formed together with the container body as a unitary structure, and is cut away from the container body and is pulled in a predetermined direction when it is intended to remove the sealing member from the container body. Or, the grip member is formed separately from the container body but is detachably mounted on the container body, and is detached from the container body and is pulled in a predetermined direction when it is intended to remove the sealing member from the container body. The grip member that is formed together with the container body as a unitary structure or is formed separately from the container body and is mounted thereon, extends outwardly beyond the wall on one side of the container body.

However, the conventional toner container of the form in which the grip member is coupled to the free end of the sealing member involves the following inconveniences.

First, the container body usually has a toner-filling hole that is formed in the side wall opposite to the side where the grip member is disposed. A toner-filling nozzle is inserted into the container body through the toner-filling hole to fill the container body with the toner and, then, the toner-filling hole is closed by a suitable closing member. When the grip member outwardly extends from the wall on one side of the container body, it is not easy to stably mount the container body on the support surface with the toner-filling hole being upwardly directed, i.e., the container body is tilted by a considerable angle due to the presence of the grip member and loses stability to a great degree. Therefore, the container body must be suitably held at the time of filling the toner, making the toner-filling operation troublesome. If the toner-filling hole and the grip member are arranged on the wall of the same side of the container body in order to avoid such a problem, on the other hand, the grip member interferes with the toner-filling nozzle, making it impossible or considerably difficult to insert the end of the toner-filling nozzle in the toner-filling hole.

Second, when the developing device having the toner container provided at a required position is used mounted on the unit frame, the grip member that outwardly extends from the wall on one side of the container body interferes with the wall on one side of the unit frame, making it impossible or very troublesome to mount the developing device on the unit frame.

Third, when the developing device having the toner container provided at a required position is used mounted on the unit frame, the grip member that is coupled to one end of the sealing member is covered by the side wall of the unit frame. Therefore, it does not allow to easily carry out the operation for removing the sealing member from the container body by pulling the grip member.

SUMMARY OF THE INVENTION

The principal object of the present invention is to provide a novel and improved toner container which reliably prevents a grip member from outwardly protruding beyond the wall on one side of a container body and permits the operation for filling the toner and/or the operation for mounting the developing device to be carried out very easily at the time when the container body is to be filled with the toner and/or when the developing device having the toner container provided at a required position is to be mounted on the unit frame, in spite of the fact that the grip member is coupled to one end of the sealing member so as to allow the sealing member to be easily removed from the container body.

Another object of the present invention is to provide a novel and improved process unit in which the developing device having the toner container provided at a required position is mounted between a pair of side walls of the unit frame and in which, when it is intended to remove the sealing member from the container body in the toner container, the grip member coupled to one end of the sealing member can be very easily gripped and pulled from the outside of the wall on one side of the unit frame.

In order to achieve the above-mentioned principal object according to the present invention, there is provided a toner container comprising a container body having an opening formed in the bottom surface thereof and a sealing member that is peelably stuck to the bottom surface of the container body to close the opening, the sealing member having one end to which is coupled a grip member that is pulled to remove the sealing member from the bottom surface of the container body to open the opening, wherein an anchor means is disposed on the outer surface of the wall on one side of the container body, and the grip member is detachably anchored thereto without outwardly protruding in the direction of width but extending along the outer surface of the wall of said one side.

In order to achieve the above another object according to the present invention, there is provided a process unit for an image-forming apparatus, comprising a unit frame having a pair of side walls arranged in the direction of width with a predetermined distance and a developing device mounted between the pair of side walls of the unit frame, the developing device having a toner container that includes a container body having an opening formed in the bottom surface thereof and a sealing member that is peelably stuck to the bottom surface of the container body to close the opening, said sealing member having one end to which is coupled a grip member that is pulled to remove the sealing member from the bottom surface of the container body to open the opening, wherein an opening and a mounting means are disposed in the wall on one side of the unit frame being juxtaposed to each other, and the grip member of the toner container is detachably mounted on said mounting means being allowed to be partly protruded outwardly through the opening.

Other objects as well as a variety of technical advantages accomplished by the present invention will become apparent from the description of a preferred embodiment of the present invention described below in detail with reference to the accompanying drawings.

DETAILED DESCRIPTION OF THE PREFERRED EMBODIMENT

A preferred embodiment of the present invention will now be described in detail with reference to the accompanying drawings.

Figure 1:
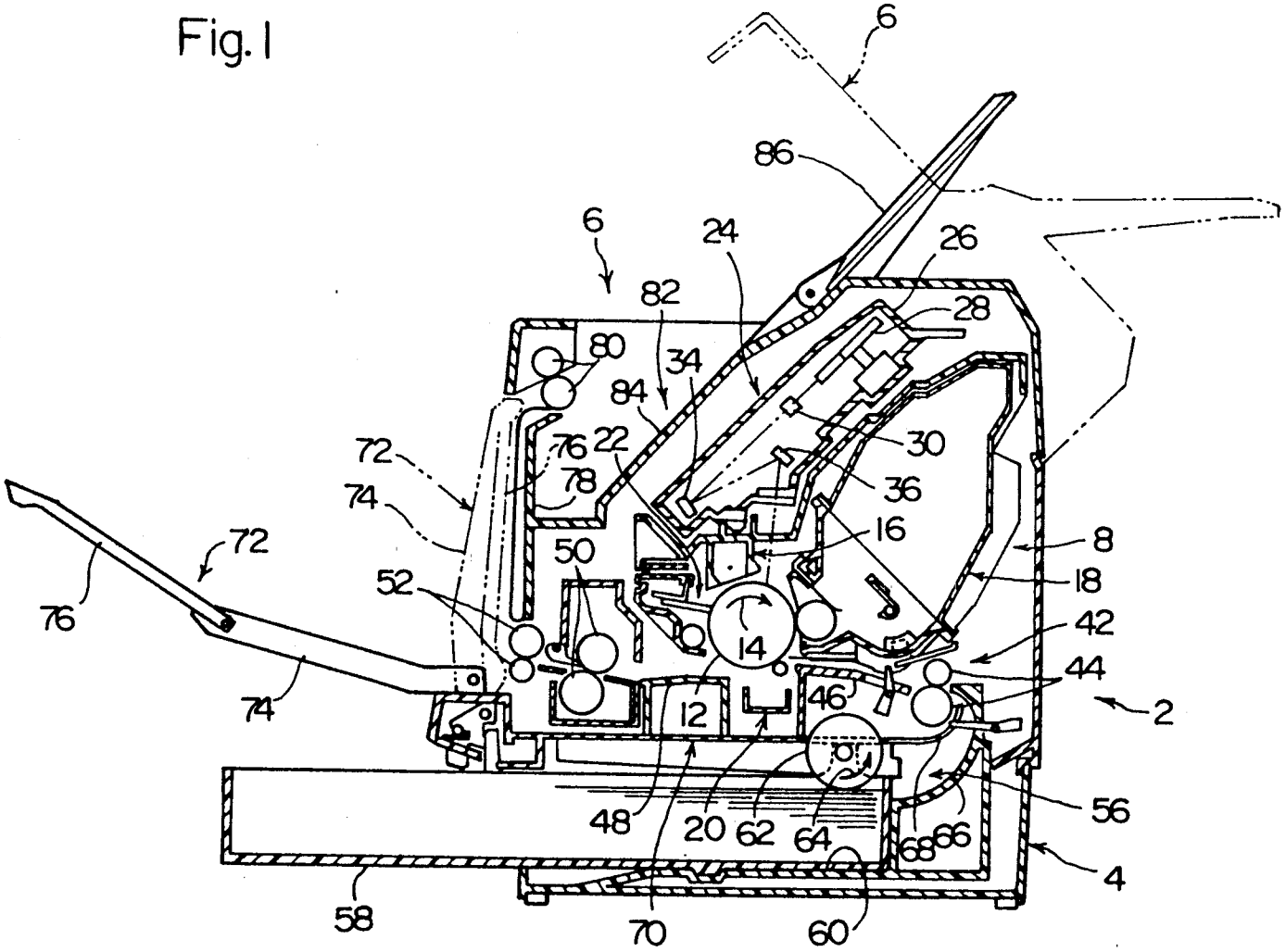
FIG. 1 is a sectional view schematically illustrating a laser printer equipped with a process unit that is constituted-according to an embodiment of the present invention.

FIG. 1 shows a laser printer equipped with a process unit which is constituted according to the present invention. A toner container and the process unit constituted according to the present invention can, as a matter of course, be adapted not only to the laser printer but also to other various kinds of image-forming machines such as electrostatic copying machines. The laser printer illustrated in FIG. 1 has a main body shown generally at 2. The main body 2 includes a lower housing 4 and an upper openable-closable housing 6 mounted on the lower housing 4. The upper housing 6 is free to pivot between a closed position shown by a solid line in FIG. 1 and an open position shown by a two-dot chain line in FIG. 1.

A process unit 8 is disposed nearly centrally in the main body 2, and is detachably mounted on the main body 2. The process unit 8 is provided with a rotary drum 12, and an electrostatographic material is disposed on the peripheral surface of the rotary drum 12. Around the rotary drum 12 to be rotated in the direction shown by an arrow 14 are disposed a charging corona discharger 16, a developing device 18, a transfer corona discharger 20 and a cleaning device 22. The rotary drum 12, the corona discharger 16, the developing device 18 and the cleaning device 22 constitute the process unit 8.

An optical unit 24 is provided in the upper portion of the inside of the main body 2, more specifically above the process unit 8. The optical unit 24 includes a box-like unit housing 26 which is mounted on the inside surface of the upper housing 6. Within the housing 26 are disposed a laser beam source (not shown), a rotary polygon mirror 28 to be revolved in a predetermined direction, an image-forming lens 30, a first reflecting mirror 34 and a second reflecting mirror 36. The laser beam source (not shown) irradiates a laser beam based on, for example, an image information outputted from a computer toward the rotary polygon mirror 28. The laser beam reflected from the rotary polygon mirror 28 reaches the first reflecting mirror 34 via the image-forming lens 30 as shown by a one-dot chain line in FIG. 1. It is reflected by the first reflecting mirror 34 and the second reflecting mirror 36 and then projected onto the surface of the rotary drum 12.

In the lower portion of the inside of the main body 2, specifically below the process unit 8, is disposed a transfer mechanism shown generally at 42. The transfer mechanism 42 includes a transfer roller pair 44, a guide plate 46, a guide plate 48, a fixing roller pair 50 and a first discharge roller pair 52 which define a transfer passage for transferring a sheet material such as a recording sheet. The upstream end portion of the transfer passage curves and extends downwardly, and at its upstream end (more specifically, below the transfer mechanism 42 and at the bottom portion of the main body 2), an automatic feed means 56 is provided. The automatic feed means 56 includes a cassette 58 for loading a stack of sheet materials. The cassette 58 is detachably loaded into a cassette-receiving section 60 defined in the bottom portion of the main body 2 through an opening formed in the left side surface of the main body 2. A feed roller 62 is disposed above the cassette-receiving section 60. When the feed roller 62 is rotated in the direction shown by an arrow 64, the sheet material is delivered from the cassette 58 by the action of the feed roller 62. The delivered sheet material passes through between a guide wall 66 of the lower housing 4 and a guiding portion 68 provided in a partitioning wall 70, and is conveyed to the conveyor roller pair 44.

The downstream end of the transfer passage is bifurcated, and an opening-closing portion 72 of the upper housing 6 is adapted to be selectively held at a first position shown by a solid line in FIG. 1 and a second position shown by a two-dot chain line in FIG. 1. When the opening-closing portion 72 composed of a first member 74 and a second portion 76 pivotally linked to the first member 74 is at the first position (at which time the second member 76 is held in a positional relationship projecting from the first member 74), the sheet material sent from the first discharge roller pair 52 is discharged out of the main body 2 and received in the upper surface of the opening-closing portion 72. On the other had, when the opening-closing portion 72 is at the second position (at which time the second member 76 is maintained in a positional relationship overlapping the first member 74), the sheet material sent from the first discharge roller pair 52 passes between the opening-closing portion 72 and an upstanding wall portion 78 of the upper housing 6 and is conveyed upwardly, and by the action of a second discharge roller pair 80, the sheet material is discharged into a receiving portion 82 defined in the upper surface of the main body 2. The receiving portion 82 is defined by an inclined upper wall 84 of the upper housing 6. An auxiliary receiving member 86 is mounted on the upper end portion of the inclined upper wall 84 for free pivotal movement between a receiving position shown in FIG. 1 and a storage position (not shown).

The operation of the laser printer will be described in a general manner.

While the rotary drum 12 is rotated in the direction of arrow 14, the charging corona discharger 16 charges the electrostatographic material of the rotary drum 12, then a laser beam from the laser beam source (not shown) of the optical unit 24 is projected onto the photosensitive member, and consequently, a latent electrostatic image corresponding to the image information is formed on the surface of the electrostatographic material. By the action of the developing device 18, a toner is applied to the latent electrostatic image on the photosensitive member. Thereafter, a sheet material such as a recording sheet fed to the transfer passage from the automatic feed means 56 is brought into contact with the photosensitive member, and by the action of the transfer corona discharger 20, the toner image on the photosensitive member is transferred to the sheet material. The sheet material having the toner image transferred thereto is peeled from the rotary drum 12 and conveyed to the fixing roller pair 50, and by the action of the fixing roller pair 50, the toner image is fixed to the surface of the sheet material. The sheet material having the toner image fixed thereto is conveyed by the first discharge roller pair 52 and discharged onto the opening-closing portion 72 when the opening-closing portion 72 is at the first position. It is seen from FIG. 1 that when the sheet material is discharged onto the opening-closing portion 72, that surface of the sheet material on which the image is formed is facing upwards. On the other hand, when the opening-closing portion 72 is at the second position, the sheet material conveyed to the discharge roller 52 is further conveyed upwardly and discharged to the receiving portion 82 by the action of the second discharge roller pair 80. As is seen from FIG. 1, when the sheet material is discharged onto the receiving portion 82, that surface of the sheet material on which the image is formed is directed downwards. In the meanwhile, the rotary drum 12 continues to be rotated, and the toner remaining on the surface of the photosensitive member is removed by the action of the cleaning device 22.

Figure 2:
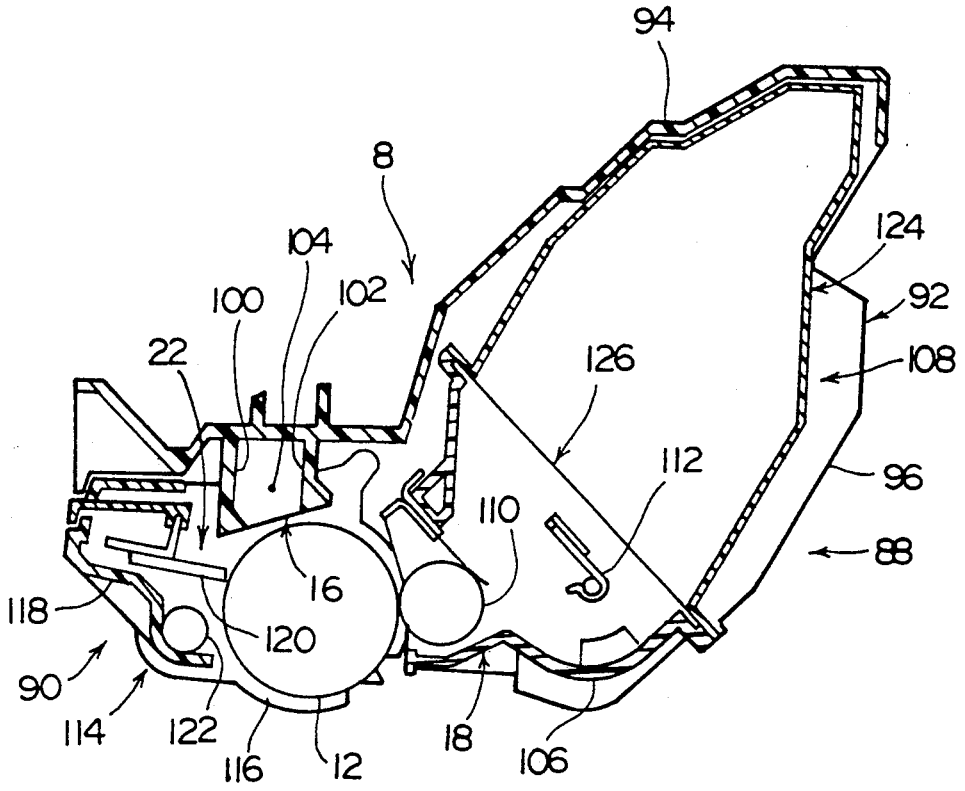
FIG. 2 is a sectional view showing process unit that is mounted on the laser printer of FIG. 1.

Referring to FIG. 2, the process unit 8 that is diagramed is constituted by a first unit 88 and a second unit 90 which are detachably coupled to each other by a suitable coupling means (not shown). The first unit 88 has a first unit frame 92 in which are disposed the charging corona discharger 16 and the developing device 18. The first unit frame 92 has an upper surface wall 94 and side walls 96 and 98 on both sides thereof (reference should also be made to FIGS. 7 and 8) that extend downwardly from both sides of the upper surface wall 94. The lower surface of the first unit frame 92 is open. The charging corona discharger 16 has a pair of shielding walls 100 and 102 that are formed integrally with the upper surface wall 94 of the first unit frame 92. A discharge wire 104 is arranged between the pair of shielding walls 100 and 102 that hang down from the upper surface wall 94. The developing device 18 includes a main frame 106 and a toner container 108 mounted on the main frame 106. In the main frame 106 are disposed a magnetic brush mechanism 110 and a stirrer mechanism 112. The developing device 18 is inserted in the first unit frame 92 from the lower side of the first unit frame 92 and is secured at a required position by a suitable fastening means (not shown). The second unit 90 has a second unit frame 114. The second unit frame 114 has side walls on both sides thereof (only one side 116 is shown in FIG. 2) that are arranged maintaining a distance in the direction of width (direction perpendicular to the surface of the paper in FIG. 2) as well as a rear surface wall 118 that extends between the two side walls. In the second unit frame 114 is rotatably mounted the rotary drum 12. The second unit frame 114 is further provided with the cleaning device 22 that includes a cleaning blade 120 and a toner conveyer mechanism 122.

Here, the constitution of the diagramed laser printer may be substantially the same as that of the laser printer disclosed in the aforementioned U.S. patent application Ser. No. 07/430,339 and corresponding European Patent Application No. 89120900.9 except the constitution related to the grip member in the toner container that will be described below in detail. Therefore, as for the detailed description of the constitution except the constitution related to the girp member in the toner container, the disclosure of the above U.S. patent application Ser. No. 07/430,339 and corresponding European Patent Application No. 89120900.9 is quoted but is not described in this specification.

Figure 3:
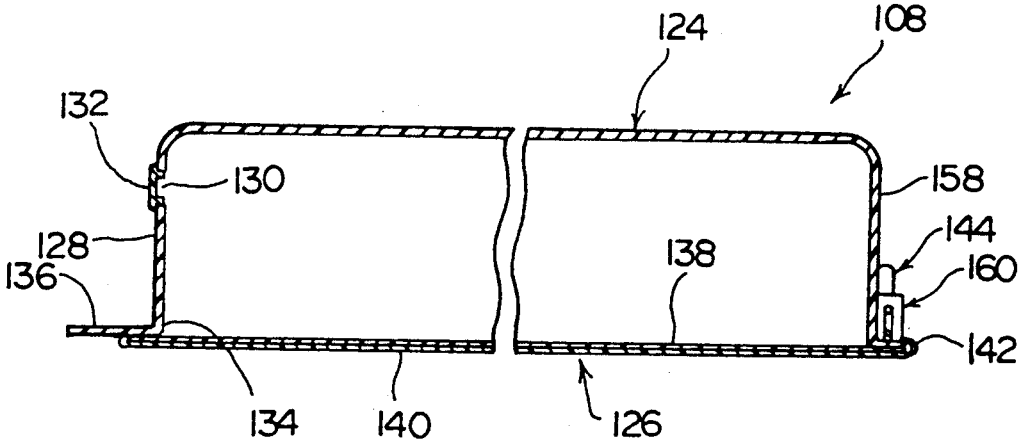
FIG. 3 is a sectional view showing a toner container of a developing device included in the process unit of FIG. 2.
Figure 4:
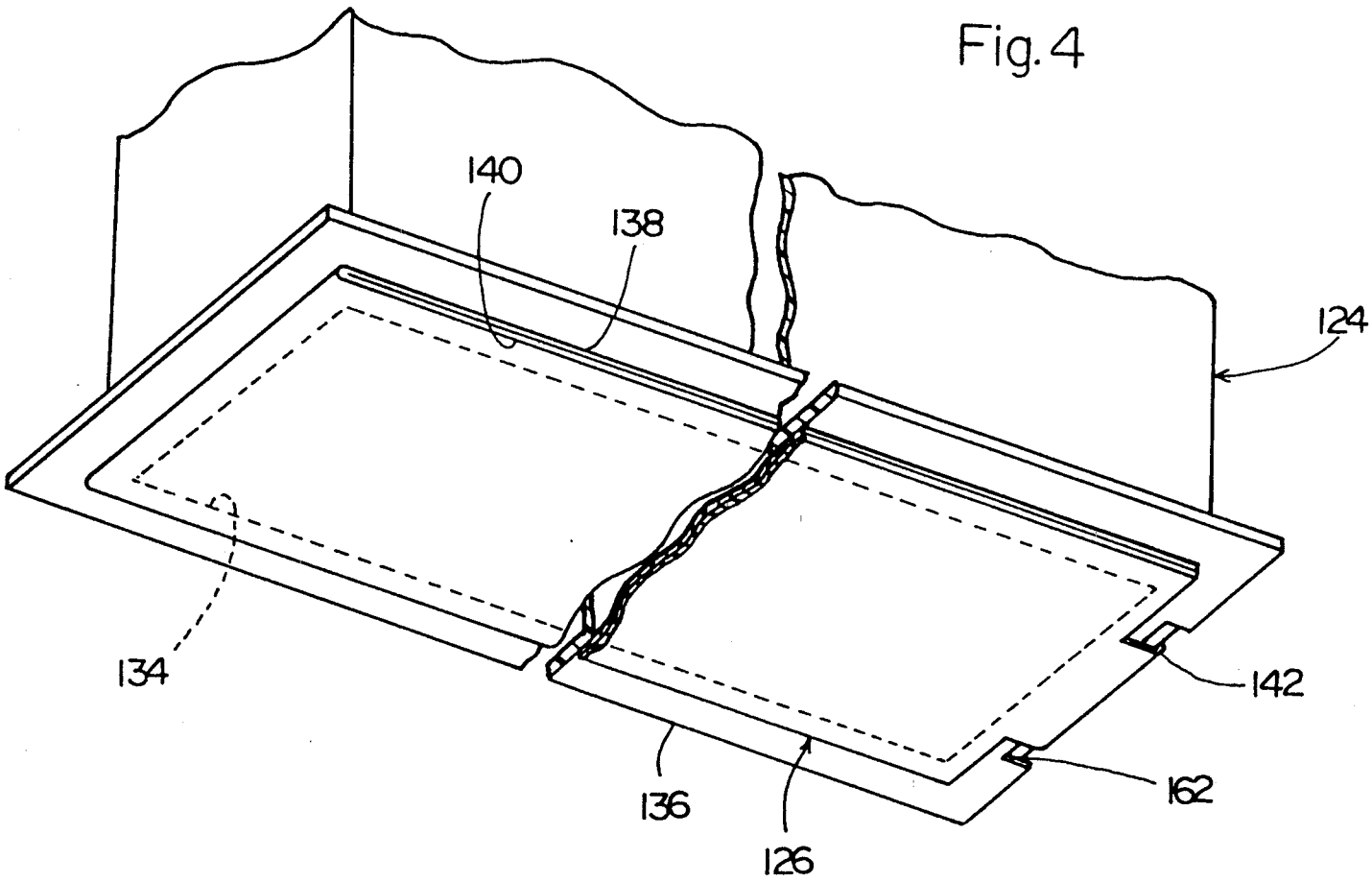
FIG. 4 is a perspective view showing the bottom surface of the toner container of FIG. 3.

Referring to FIGS. 3 and 4, the toner container 108 includes a container body 124 and a sealing member 126. The container body 124 that can be made of a suitable synthetic resin is of a hollow box-like shape and has a toner-filling hole 130 (FIG. 3) formed in the side wall 128 thereof. A toner-filling nozzle is inserted in the container body 124 through the toner-filling hole 130 to fill the container body 124 with the toner. After the toner is filled, a closing member 132 (FIG. 3) is fixed to the toner-filling hole 130 to close the toner-filling hole 130. As clearly shown in FIG. 4, a rectangular opening 134 is formed over nearly the whole bottom surface of the container body 124. Furthermore, in the bottom surface of the container body 124 is formed a rectangular flange 136 that outwardly extends from all of the four sides of the opening 134.

The opening 134 formed in the bottom surface of the container body 124 is closed by the sealing member 126. The sealing member 126 which can be made of a suitable synthetic resin film has a stuck portion 138 that extends covering the opening 134 from one side (right side in FIG. 3) of the container body 124 to the other side (left side in FIG. 3) thereof, and a folded portion 140 that following the stuck portion 138 in a direction opposite to the stuck portion 138, extends along the outer surface of the stuck portion 138 from the above other side toward the above one side of the container body 124. The stuck portion 138 is peelably stuck to the bottom surface of the container body 124, or more specifically to the lower surface of the rectangular flange 136 by a suitable means such as heat-melting or adhesion thereby to close the opening 134.

Figure 5:
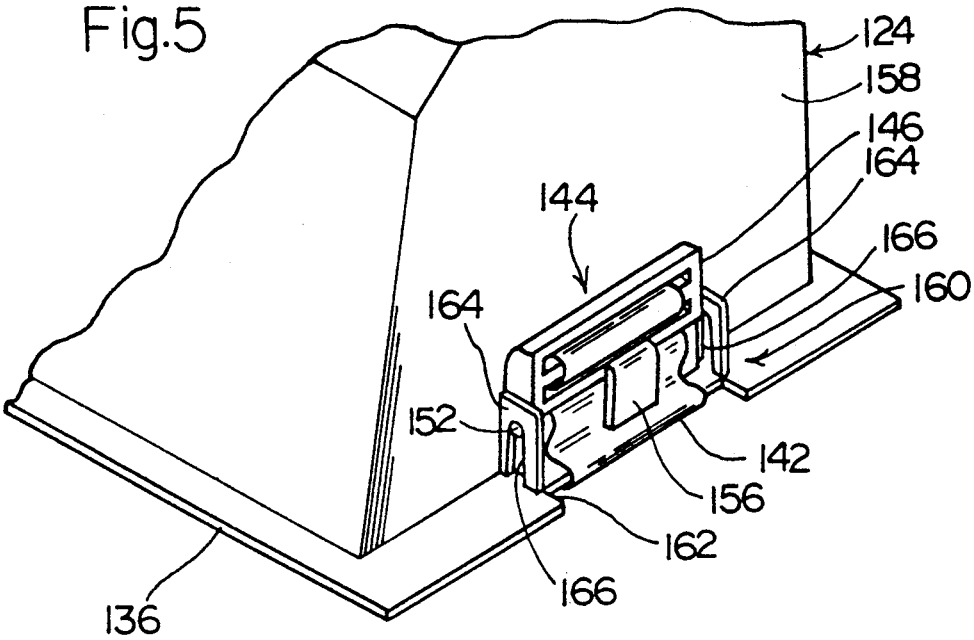
FIG. 5 is a perspective view showing a side portion of the toner container of FIG. 3.
Figure 6:
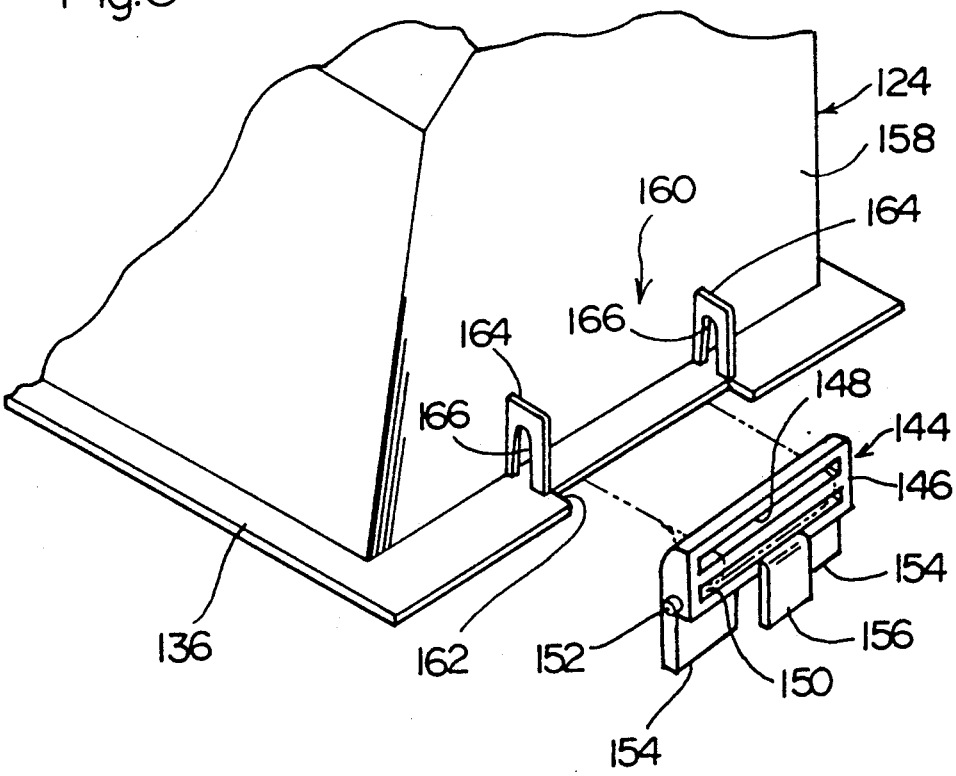
FIG. 6 is a perspective view showing the side portion of the toner container of FIG. 3 under the contition where an anchor means and a grip member are separated from each other.

If further described with reference to FIGS. 5 and 6 together with FIGS. 3 and 4, the folded portion 140 of the sealing member 126 has a free end 142 that is slightly narrowed, and a grip member 144 is coupled to the free end 142. The grip member 144 which can be made of a suitable synthetic resin has a main part 146 of the shape of a rectangular plate, and a pair of slits 148 and 150 are formed in the main part 146 maintaining a distance in the up-and-down direction. The free end 142 of the sealing member 126 is inserted to the slit 148 from the side of one surface of the grip member 144, and then is inserted to the slit 150 from the side of other surface of the grip member 144, and the free end thus wound on the grip member 144 is joined like a ring thereby to be coupled to the grip member 144. Protrusions 152 having a circular shape in cross section are formed on both side end surfaces of the main part 146 of the grip member 144. Furthermore, the grip member 144 has a pair of leg portions 154 that downwardly protrude from both ends on one surface thereof and that are formed integrally, and has a mounting protrusion 156 that downwardly protrudes from the central portion on the other surface thereof and that is formed integrally.

An anchor means 160 to which the grip member 144 is detachably anchored is disposed on the side wall 158 of the container body 124. In the diagramed embodiment, the flange 136 has a notch 162 that is formed on one side in the bottom surface of the container body 124, the notch 162 having a width corresponding to the width of the free end 142 of the sealing member 126. A pair of anchor pieces 164 which extend upwardly are formed on the upper surface of the flange 136 to correspond to both side edges of the notch 16. The distance between the pair of anchor pieces 164 corresponds to the width of the main part 146 of the grip member 144. A slit 166 extending in the up-and-down direction is formed in each of the pair of anchor pieces 164 that constitute the anchor means 160.

The grip member 144 to which the sealing member 126 is coupled is anchored to the anchor means 160 that is disposed on the side wall 158 of the container body 124. To anchor the grip member 144 to the anchor means 160 as will be understood with reference to FIGS. 5 and 6, the grip member 144 is forcibly brought to between the pair of anchor pieces 164 that constitute the anchor means 160, and the protrusions 152 formed on both side end surfaces of the grip member 144 are inserted in the slits 166 formed in the anchor pieces 164. In this case, the anchor pieces 164 are resiliently deformed to some extent toward both side directions. As the grip member 144 is brought into engagement with the anchor means 160 as shown in FIG. 5, insertion of the protrusions 152 in the slits 166 prevents the grip member 144 from moving in the direction of width relative to the anchor means 160. Furthermore, since the protrusions 152 are inserted in the slits 166, and the pair of leg portions 154 of the grip member 144 are brought into contact with the upper surface of the flange 136, the grip member 144 is prevented from moving in the up-and-down direction relative to the anchor means 160. The grip member 144 that is anchored to the anchor means 160 as required, is positioned extending along the side wall 158 of the container body 124 without outwardly protruding in the direction of width beyond the flange 136 of the container body 124. Therefore, when the container body 124 with its side wall 128 directed upwards and the side wall 158 directed downwards is placed on the support surface in order to fill the container body 124 with the toner through the toner-filling hole 130 that is formed in the side wall 128 of the container body 124, it can be fully stable on the support surface without being interfered with by the presence of the grip member 144.

Referring to FIG. 2, the toner container 108 is mounted as required on the main frame 106 of the developing device 18 which is then entirely inserted in the first unit frame 92 from the lower side thereof and is secured at a required position between the two side walls 96 and 98 of the first unit frame 92. When the toner container 108 is mounted on the main frame 106 of the developing device 18, the opening 134 of the container body 124 that is closed by the sealing member 126 is faced to the upper surface that is open of the main frame 106. Here, since the grip member 144 of the toner container 108 extends along the side wall 158 of the container body 124 without protruding beyond the flange 136 of the container body 124 as shown in FIG. 5, it is allowed to very easily insert the developing device 18 in the first unit frame 92 without apprehension that the grip member 144 might come in collision with the side wall 98 of the first unit frame 92.

Figure 7:
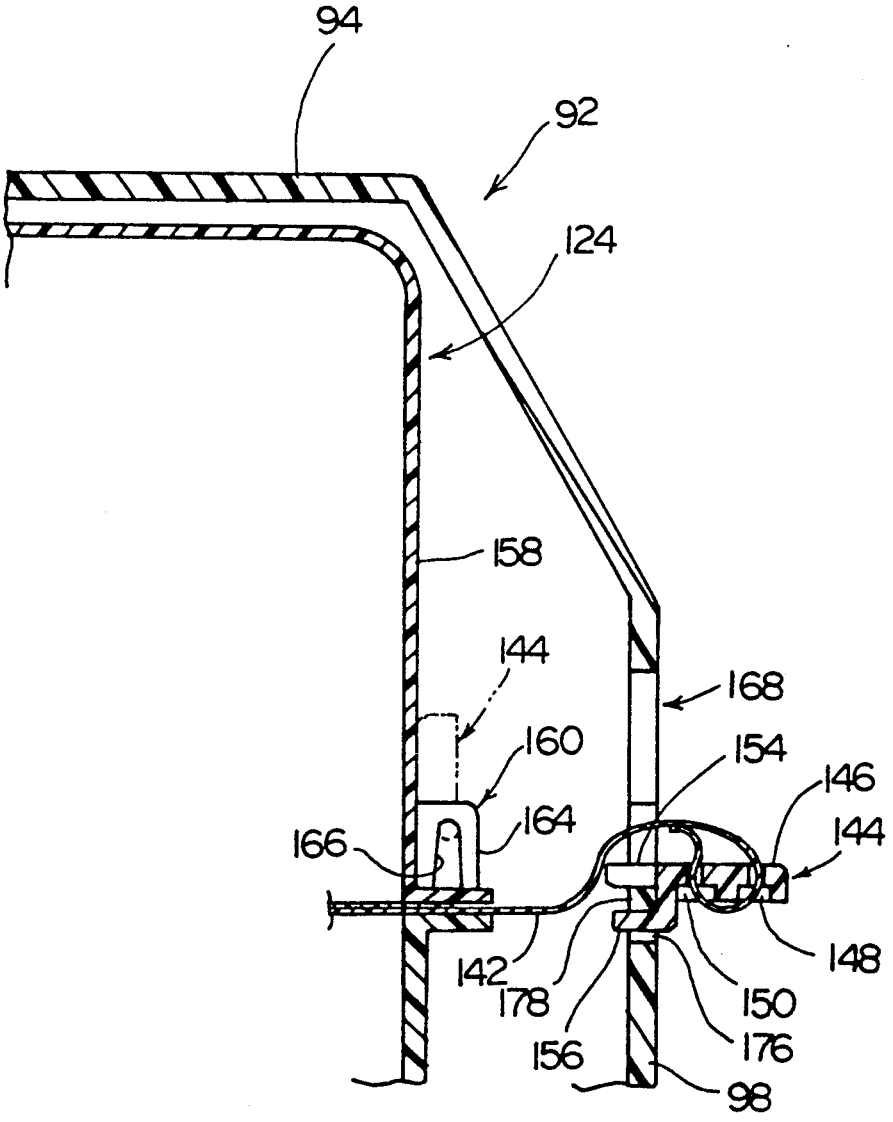
FIG. 7 is a sectional view showing a portion of the process unit of FIG. 2.
Figure 8:
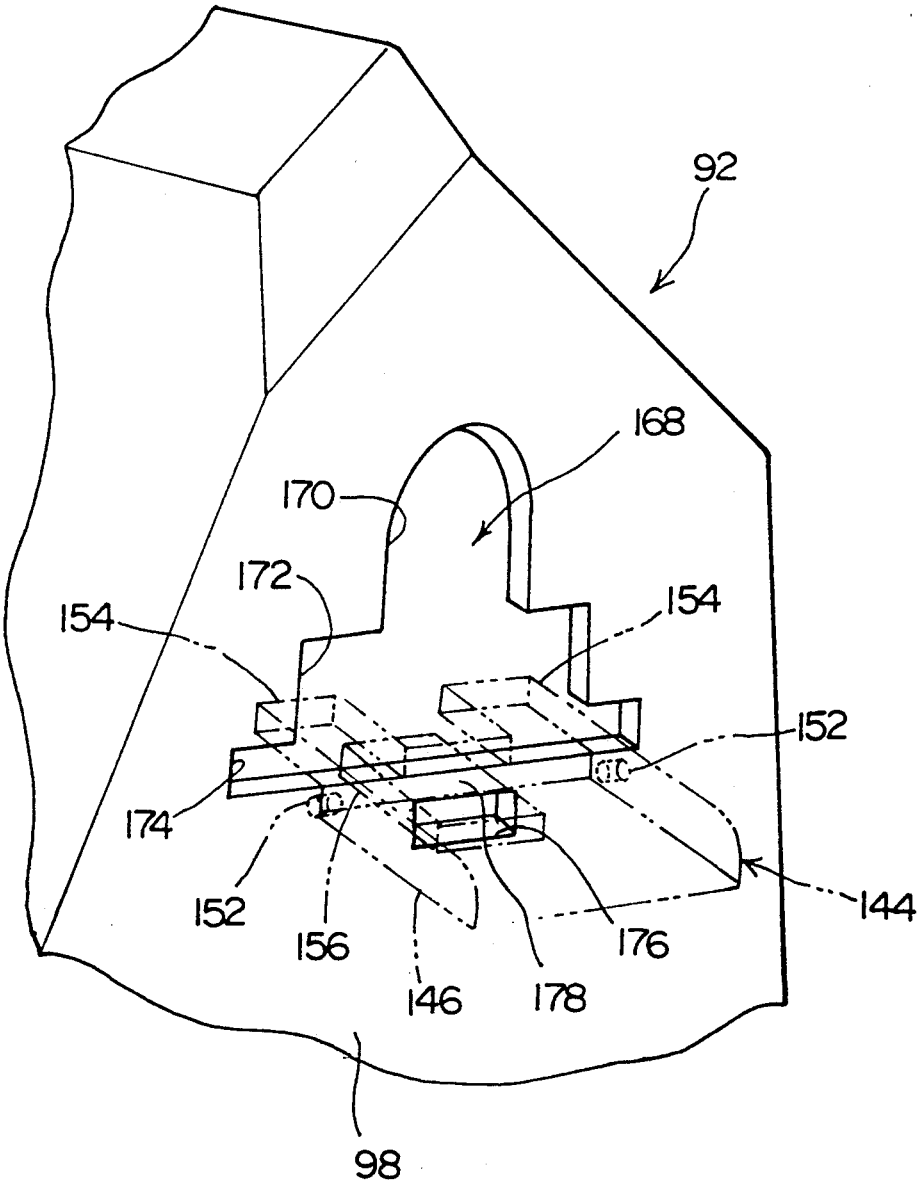
FIG. 8 is a perspective view showing a portion on one side of the process unit of FIG. 2.

If further described with reference to FIGS. 7 and 8, the side wall 98 of the first unit frame 92 has an opening 168 formed therein to correspound to the grip member 144 of the toner container 108. The opening 168 has an upper half portion 170 which is relatively narrow, an intermediate main portion 172, and a lower end portion 174 which is relatively wide. The width of the intermediate main portion 172 corresponds to the width of the main part 146 of the grip member 144. The side wall 98 further has a slit 176 that is located at a lower position close to the opening 168. The slit 176 and a rod-like portion 178 that remains between the opening 168 and the slit 176 constitute means for fitting the grip member 144.

After the developing device 18 is mounted at a required position in the first unit frame 92, fingers are inserted in the opening 168 formed in the side wall 98 of the first unit frame 92 to grip the main part 146 of the grip member 144 of the toner container 108 to pull it forward. Then, the grip member 144 turns forward with the lower ends (the lower ends are in contact with the upper surface of the flange 136) of the pair of leg portions 154 of the grip member 144 as a center, the pair of anchor pieces 164 constituting the anchor means 160 undergo elastic deformation to some extent, the protrusions 152 of the grip member 144 are disengaged from the slits 166 of the anchor pieces 164, and the grip member 144 is moved forward so as to be separated from the anchor means 160. Thereafter, the mounting protrusion 156 of the grip member 144 is inserted in the slit 176 that is formed in the side wall 98 of the first unit frame 92, and the rod-like portion 178 of the side wall 98 is resiliently held by the mounting protrusion 156 of the grip member 144 and by the pair of leg portions 154. Thus, the grip member 144 is mounted on the side wall 98; i.e., the grip member 144 is mounted on the side wall 98 being partly and outwardly protruded through the opening 168 as indicated by solid lines in FIG. 7 and as indicated by two-dot chain lines in FIG. 8. The process unit 8 is delivered to the users under the condition shown in FIGS. 7 and 8. To use the process unit 8 which is mounted on the main body 2 (FIG. 1) of the laser printer, the user grips the grip member 144 that partly protrudes beyond the first unit frame 92 and pulls it forward to separate it away from the side wall 98. Thus, the sealing member 126 is removed from the container body 124, so that the opening 134 of the container body 124 is opened and the toner contained in the container body 124 is fed into the main frame 106 of the developing device 18. At the time when the process unit 8 is delivered to the user, the grip member 144 of the toner container 108 has been partly protruded through the opening 168 that is formed in the side wall 98 of the first unit frame 92. Therefore, the user is allowed to very easily grip the grip member 144 to remove the sealing member 126 from the container body 124.

Though the present invention was described above in detail by way of a preferred embodiment in conjunction with the accompanying drawings, it should be noted that the present invention is in no way limited to the above embodiment only, but can be changed or modified in a variety of other ways without departing from the scope of the present invention.

What we claim is:

1. A toner container comprising:

a container body having an opening formed in the bottom surface thereof, and a sealing member that is peelably stuck to said bottom surface of said container body to close said opening, said sealing member having one end to which is coupled a grip member that is adapted to be pulled to remove said sealing member from said bottom surface of said container body to open said opening, an anchor means is disposed on an outer surface of a wall on one side of said container body, and said grip member is detachably anchored thereto without outwardly protruding in a width direction, said grip member extending along said outer surface of said wall of said one side.

2. A toner container according to claim 1, wherein said sealing member has a stuck portion that is peelably stuck to said bottom surface of said container body, said sealing member extending from one side to another side of said bottom surface and having a folded portion that extends from said another side to said one side on said bottom surface of said container body along an outer surface of said stuck portion, and wherein said grip member is coupled to a free end of said folded portion.

3. A toner container according to claim 1 or 2, wherein a flange that outwardly protrudes in said width direction is formed on said one side of said bottom surface of said container body, said anchor means is constituted by a pair of anchor pieces that upwardly extend from an upper surface of said flange and maintain a predetermined distance, and wherein said grip member is resiliently fitted with said pair of anchor pieces.

4. A toner container according to claim 3, wherein a slit is formed in each of said anchor pieces, and said grip member has a pair of protrusions, one of said protrusions being insertable in a slit of one of said anchor pieces and the other of said protrusions being insertable in the slit of the other anchor piece of said pair of anchor pieces.

5. A process unit for an image-forming apparatus, said process unit comprising:

a unit frame having a pair of side walls arranged in a direction of width with a predetermined distance and a developing device mounted between said pair of side walls of said unit frame, said developing device having a toner container that includes a container body having an opening formed in a bottom surface thereof and a sealing member that is peelably stuck to said bottom surface of said container body to close said opening, said sealing member having one end to which is coupled a grip member that is adapted to be pulled to remove said sealing member from said bottom surface of said container body to open said opening, wherein an opening and mounting means are located at a wall on one side of said unit frame and juxtaposed to each other, and wherein said grip member of said toner container is detachably mountable on said mounting means so as to partly protrude outwardly through said opening of said wall of said unit frame.

6. A process unit according to claim 5, wherein said sealing member has a stuck portion that is peelably tuck to said bottom surface of said container body, said sealing member extending from one side to another side of said bottom surface and having a folded portion that extends from said another side to said one side on said bottom surface of said container body along an outer surface of said stuck portion, and wherein said grip member is coupled to a free end of said folded portion.

7. A process unit according to claim 5, wherein said mounting means has a slit that is formed adjacent to said opening, said grip member has a mounting protrusion, and said mounting protrusion is inserted in said slit, whereby said grip member is resiliently mounted on said mounting means.

8. A process unit according to claim 5, wherein an anchor means is disposed on an outer surface of a wall on one side of said container body of said toner container such that said grip member is detachably anchored thereto without outwardly protruding in a width direction, said grip member extending along said outer surface of said wall of said one side of said container body.

9. A process unit according to claim 8, wherein a flange that outwardly protrudes in said width direction is formed on said one side of said bottom surface of said container body, said anchor means is constituted by a pair of anchor pieces that upwardly extend from an upper surface of said flange and maintain a predetermined distance, and wherein said grip member is resiliently fitted between said pair of anchor pieces.

10. A process unit according to claim 9, wherein a slit is formed in each of said anchor pieces, and said grip member has a pair of protrusions one of said protrusions being insertable in a slit of one of said anchor pieces and the other of said protrusions being insertable in the slit of the other anchor piece of said pair of anchor pieces.

11. A process unit according to claim 6, wherein said mounting means has a slit that is formed adjacent to said opening, said grip member has a mounting protrusion, and said mounting protrusion is inserted in said slit, whereby said grip member is resiliently mounted on said mounting means.

12. A process unit according to claim 6, wherein an anchor means is disposed on an outer surface of a wall on one side of said container body of said toner container such that said grip member is detachably anchored thereto without outwardly protruding in a width direction, said grip member extending along said outer surface of said wall of said one side of said container body.

* * * * *